US009370068B2

(12) United States Patent
Hick et al.

(10) Patent No.: US 9,370,068 B2
(45) Date of Patent: Jun. 14, 2016

(54) DIMMING AND CONTROL ARRANGEMENT AND METHOD FOR SOLID STATE LAMPS

(75) Inventors: Robert L. Hick, Newberg, OR (US); Richard A. Leinen, Wilsonville, OR (US)

(73) Assignee: LEVITON MANUFACTURING COMPANY, INC., Melville, NY (US)

( * ) Notice: Subject to any disclaimer, the term of this patent is extended or adjusted under 35 U.S.C. 154(b) by 563 days.

(21) Appl. No.: 13/328,707

(22) Filed: Dec. 16, 2011

(65) Prior Publication Data

US 2013/0154504 A1 Jun. 20, 2013

(51) Int. Cl.
*H05B 37/02* (2006.01)
*H05B 33/08* (2006.01)

(52) U.S. Cl.
CPC ..... *H05B 33/0845* (2013.01); *H05B 37/0245* (2013.01)

(58) Field of Classification Search
CPC ..... H05B 33/0893; H05B 33/0845; H05B 37/0245
USPC ..... 315/DIG. 4, 287, 294
See application file for complete search history.

(56) References Cited

U.S. PATENT DOCUMENTS 3,218,511 A 11/1965 Rosenbaum
3,243,653 A * 3/1966 Locklin ..... 315/194
3,935,505 A 1/1976 Spiteri
4,396,869 A 8/1983 Rosenbaum et al.
4,651,060 A 3/1987 Clark
5,001,386 A 3/1991 Sullivan et al.
5,004,957 A 4/1991 Cunningham
5,041,763 A 8/1991 Sullivan et al.
5,144,205 A 9/1992 Motto et al.
5,173,643 A 12/1992 Sullivan et al.
5,327,047 A 7/1994 Gershen
5,619,081 A 4/1997 Gershen et al.
5,684,376 A 11/1997 Neiger et al.
5,686,799 A 11/1997 Moisin et al.
5,719,471 A 2/1998 Kachmarik
5,789,894 A 8/1998 Neiger et al.

(Continued)

FOREIGN PATENT DOCUMENTS

EP 1965611 A1 9/2008
WO 2009127340 A2 10/2009

OTHER PUBLICATIONS

International Search Report and Written Opinion for PCT/US2010/052145, dated Jun. 28, 2011, 11 pages.

(Continued)

*Primary Examiner* — Daniel D Chang

(57) ABSTRACT

A system and method are disclosed for dimming light emitting diode (LED) lamps. A control unit is coupled to a dimmer and LED lamp. The dimmer receives power from an AC source and determines a phase angle of the AC power. The dimmer provides DC power to the lamp based on the phase angle. The control unit sends a control signal to the dimmer during a first portion of each half sine-wave of the received AC power. The control signal causes the dimmer to modify at least one function of the lamp. A plurality of LED lamps may be associated with a single dimmer, and the dimmer may individually instruct the lamps to modify their operational characteristics. The dimmer may send an operational signal back to the control unit. The operational signal may represent end of life information for the associated LED lamp. Other embodiments are described and claimed.

25 Claims, 9 Drawing Sheets

(56) References Cited

U.S. PATENT DOCUMENTS

| | | | | |
|---|---|---|---|---|
| 5,798,617 | A | 8/1998 | Moisin | |
| 5,841,238 | A | 11/1998 | Van Veldhuizen et al. | |
| 5,841,239 | A | 11/1998 | Sullivan et al. | |
| 5,854,519 | A | 12/1998 | Gershen et al. | |
| 5,864,212 | A | 1/1999 | Sullivan | |
| 5,866,993 | A | 2/1999 | Moisin | |
| 5,955,841 | A | 9/1999 | Moisin et al. | |
| 5,994,848 | A | 11/1999 | Janczak | |
| 6,011,357 | A | 1/2000 | Gradzki et al. | |
| 6,043,611 | A | 3/2000 | Gradzki et al. | |
| 6,133,696 | A | 10/2000 | Tavares et al. | |
| 6,153,984 | A | 11/2000 | Fishbein et al. | |
| 6,175,195 | B1 | 1/2001 | Janczak et al. | |
| 6,400,098 | B1 | 6/2002 | Pun | |
| 6,452,344 | B1 | 9/2002 | MacAdam et al. | |
| 6,577,076 | B2 | 6/2003 | Li et al. | |
| 6,603,274 | B2 | 8/2003 | Ribarich et al. | |
| 6,642,669 | B1 | 11/2003 | MacAdam et al. | |
| 6,727,665 | B2 | 4/2004 | Yao | |
| 7,038,399 | B2 * | 5/2006 | Lys et al. | 315/291 |
| 7,088,059 | B2 | 8/2006 | McKinney et al. | |
| 7,102,902 | B1 | 9/2006 | Brown et al. | |
| 7,109,665 | B2 | 9/2006 | Green | |
| 7,110,225 | B1 | 9/2006 | Hick | |
| 7,132,802 | B2 | 11/2006 | Fischer et al. | |
| 7,164,238 | B2 | 1/2007 | Kazanov et al. | |
| 7,224,125 | B2 | 5/2007 | Ribarich | |
| 7,242,563 | B2 | 7/2007 | Hua | |
| 7,288,902 | B1 | 10/2007 | Melanson | |
| 7,329,996 | B2 | 2/2008 | Hsu | |
| 7,482,756 | B2 | 1/2009 | Kesterson | |
| 7,667,408 | B2 | 2/2010 | Melanson et al. | |
| 7,759,881 | B1 | 7/2010 | Melanson | |
| 7,852,017 | B1 | 12/2010 | Melanson | |
| 8,154,154 | B2 | 4/2012 | Buerer | |
| 8,198,829 | B2 | 6/2012 | Balasubramanian | |
| 2002/0140373 | A1 | 10/2002 | Ribarich et al. | |
| 2003/0112083 | A1 * | 6/2003 | Atallah et al. | 331/57 |
| 2003/0222604 | A1 | 12/2003 | Yao | |
| 2004/0032222 | A1 | 2/2004 | Green | |
| 2004/0207337 | A1 | 10/2004 | Fischer et al. | |
| 2004/0212321 | A1 * | 10/2004 | Lys et al. | 315/291 |
| 2005/0104543 | A1 | 5/2005 | Kazanov et al. | |
| 2005/0206529 | A1 * | 9/2005 | St.-Germain | 340/815.45 |
| 2006/0023002 | A1 | 2/2006 | Hara et al. | |
| 2007/0182347 | A1 * | 8/2007 | Shteynberg et al. | 315/312 |
| 2008/0224636 | A1 * | 9/2008 | Melanson | 315/307 |
| 2009/0108765 | A1 | 4/2009 | Weightman et al. | |
| 2009/0212721 | A1 * | 8/2009 | Maruyama | 315/307 |
| 2010/0270948 | A1 | 10/2010 | Wang et al. | |
| 2011/0062933 | A1 | 3/2011 | Tosuntikool | |
| 2011/0109297 | A1 | 5/2011 | Tosuntikool | |
| 2011/0115448 | A1 | 5/2011 | Elliott | |
| 2011/0115460 | A1 | 5/2011 | Elliott | |
| 2011/0156610 | A1 | 6/2011 | Ostrovsky | |

OTHER PUBLICATIONS

Leviton—Technical Application Note—"Programming Guide for Vizia + Dimmers and Quiet Fan Speed Control," 2008, 4 pages.

Leviton—Universal Dimmer (Single Pole or 3 Way), Cat. No. HCM06-ID (lighted), Dec. 29, 2009, 2 pages.

Littelfuse, Inc. "AN1002—Teccor Brand Thyristors," Gating, Latching, and Holding of SCRs and Triacs, 2008, 5 pages.

Littelfuse, Inc., "AN-1003—Teccor Brand Thyristors," Phase Control Using Thyristors, 2008 9 pages.

"LED Dimming implemented on STM32tm microcontroller," AN2841, Application Note, Nov. 2008, Rev.1, www.st.com.

Gulati, A., "Modulation Techniques for LEF Dimming," AN49262, Doc. No. 001-49262 Rev. **, Oct. 2, 2008, (c) Cypress Semiconductor Corporation, www.cypress.com.

Rosen, R, "Dimming Techniques for Switched-Mode LED Drivers," POWERdesigner, (c) 2009, National Semiconductor Corporation.

* cited by examiner

DIMMING AND CONTROL ARRANGEMENT AND METHOD FOR SOLID STATE LAMPS

FIELD OF THE DISCLOSURE

The present disclosure relates generally to dimming arrangements for lighting systems, and more particularly to an improved dimming arrangement and control method for dimming modern light emitting diode (LED) lighting systems.

BACKGROUND OF THE DISCLOSURE

It is widely known that light emitting diode (LED) lamps are more energy efficient than incandescent lamps, and thus there is a growing demand for LED lamps that can directly replace incandescent lamps. Many incandescent lamps are installed with a dimmer that varies the brightness. However, incandescent dimmers cannot be used to dim LED lamps without the risk of operational and equipment problems because of the differing construction between LED lamps and incandescent lamps.

For example, incandescent lamps use a wire filament that is directly connected to a supply voltage. As such, an incandescent dimmer can use low cost components such as triacs (triodes) to switch on the voltage at a variable point of the alternating current (AC) sine wave during the negative and positive halves of the wave. This causes the incandescent lamp filament to receive current for longer or shorter durations, which causes the filament to vary in brightness. The dimmer usually transitions from 100% duty cycle to less than 1% duty cycle, which varies the RMS power delivered to the lamp to adjust the brightness from minimum to maximum.

LED lamps are constructed differently from incandescent lamps. For example, LED lamps include sophisticated electronic components and may need to be supplied with a certain amount of constant power in order to maintain the functional state of the components. In addition, LED lamps may include additional functionality, such as color control, that cannot be manipulated by incandescent dimmers.

Thus, there is a need for an improved control technique for LED lamps to enable efficient dimming operation that is safe for LED circuitry and that enables control of additional LED features, including color control, enhanced monitoring of LED lamp life, and coordinated control of multiple LED lamps associated with one or more dimmers.

SUMMARY OF THE DISCLOSURE

A system for dimming a light emitting diode lamp is disclosed. The system includes an LED lamp, and a dimmer coupled to the LED lamp. The dimmer may be configured to receive electrical power from an alternating current (AC) source, and to determine a phase angle of the received AC power. The dimmer may provide direct current (DC) power to the LED lamp based on the determined phase angle. The dimmer can provide a dimming range of the LED lamp in a range between a maximum brightness condition of the LED lamp and an off condition of the LED lamp. The received electrical power may provide a constant minimum level of electrical power to circuit components associated with at least one of the dimmer and the LED lamp.

A method is disclosed for controlling brightness of an LED lamp. The method comprises receiving, at an LED dimmer, electrical power from an alternating current (AC) source; determining, at the LED dimmer, a phase angle of said received AC power, and sending, from the LED dimmer, power to the LED lamp to operate the LED lamp at a brightness based on the determined AC phase angle. The brightness of the LED may be in a range between a maximum brightness condition of the LED lamp and an off condition of the LED lamp. The received electrical power may provide a constant minimum level of electrical power to circuit components associated with at least one of the dimmer and the LED lamp.

A system is disclosed for controlling a light emitting diode lamp for use in a system comprising an LED lamp connected to and in communication with a dimmer, and a non-transient machine readable storage medium encoded with a computer program code such that, when the computer program code is executed by a processor, the processor performs a method comprising: receiving, at the dimmer, electrical power from an alternating current (AC) source; determining, at the LED dimmer, a phase angle of the received AC power, and providing direct current (DC) power from the dimmer to an LED lamp, where the DC power is representative of a predetermined brightness of the LED lamp. The DC power can be based on the determined AC phase angle. The predetermined brightness of the LED may be in a range between a maximum brightness condition of the LED lamp and an off condition of the LED lamp. The received electrical power can be sufficient to maintain a functionality of a circuit component associated with at least one of the dimmer and the LED lamp.

BRIEF DESCRIPTION OF THE DRAWINGS

By way of example, a specific embodiment of the disclosed device will now be described, with reference to the accompanying drawings, in which.

DETAILED DESCRIPTION

A system and method are disclosed for dimming an LED lamp. In an exemplary embodiment, a control unit may be configured to send alternating current (AC) having a predetermined phase angle to an LED dimmer. It will be appreciated that in addition to the specific features that will be described in detail below, the disclosed LED dimmer can include some or all of the functionality normally associated with an LED driver. A processor associated with the LED dimmer can detect the AC phase angle, and, in turn, can provide power to an LED lamp to obtain a desired lamp brightness. By adjusting the phase angle of the AC power provided to the LED dimmer, the control unit can "instruct" the LED dimmer to power the LED lamp 8 at a particular brightness level (such as by providing a particular direct current (DC) pulse width or DC current to the LED lamp 8). Automatic or manual user controls may be associated with the control unit, and may thus be used to enable user selection of LED brightness.

In addition, an improved LED lamp/dimmer system is disclosed in which control signals can be sent between a control unit and LED dimmer to instruct particular operation of an associated LED lamp (or plurality of lamps, where more than one lamp is controlled by a single dimmer). In further embodiments, the dimmer may send signals back to the control unit to provide the control unit with information regarding one or more operating conditions of the lamp.

As will be appreciated, the disclosed arrangement provides intelligent control and feedback for an LED lamp/dimmer arrangement. This arrangement can provide for enhanced control of one or more LED lamps.

Figure 1:
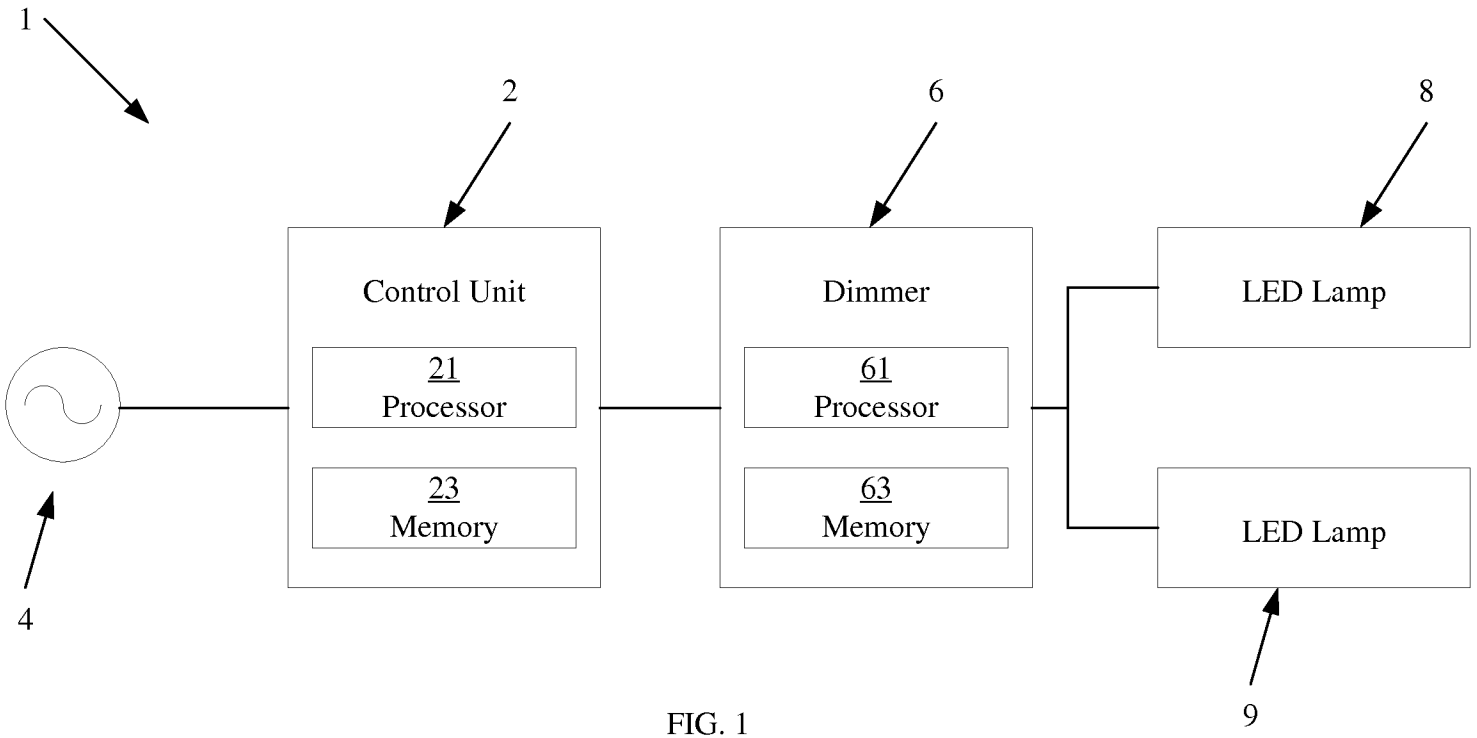
FIG. 1 is a schematic diagram of an embodiment of the disclosed system.

Referring to FIG. 1, an exemplary dimming system 1 for an LED lamp is shown. The system 1 may include a control unit 2 configured to receive AC or DC power from a power source 4 and to transmit that power to a dimmer 6 as AC current. The dimmer 6, in turn, may be coupled to an LED lamp 8 and/or an LED Lamp 9. In one embodiment, the control unit 2 may be mounted in the nature of a wall box, and/or may include a user interface (see FIG. 2) to enable a user to control one or more operations of the LED lamp 8. For example, the control unit 2 may operate to enable a user to adjust the brightness of the LED Lamp 8 and/or the LED Lamp 9. Furthermore, in some examples, the control unit 2 may include a processor 21 and a memory 23 associated with the processor 23. In some examples, the dimmer 6 may include a processor 61 and a memory 63 associated with the processor 61.

For simplicity, the FIG. 1 arrangement shows a single dimmer 6 and a two LED lamps 8 and 9 associated with the control unit 2. It will be appreciated, however, that control unit 2 can be used to control a plurality of LED dimmers 6. In addition, a single LED dimmer 6 can be used to control a plurality of LED lamps (e.g., LED Lamp 8, LED Lamp 9, and/or the like). In one exemplary embodiment, a single control unit 2 can be used to control a plurality of dimmers 6, each of which, in turn, can be used to control the function of a plurality of individual LED lamps (e.g., LED Lamp 8, LED Lamp 9, and/or the like) arrayed in one or more rooms of a building (or even multiple buildings). In addition, the control unit 2 may be configured to enable manual user control, automated (i.e., computer) control, or a combination of both. For example, the control unit 2 and dimmer(s) 6 may receive information from a utility or building automation system and can use that information to instruct one or more LED lamps (e.g., LED Lamp 8, LED Lamp 9, and/or the like) to operate at particular predetermined power levels.

Figure 2:
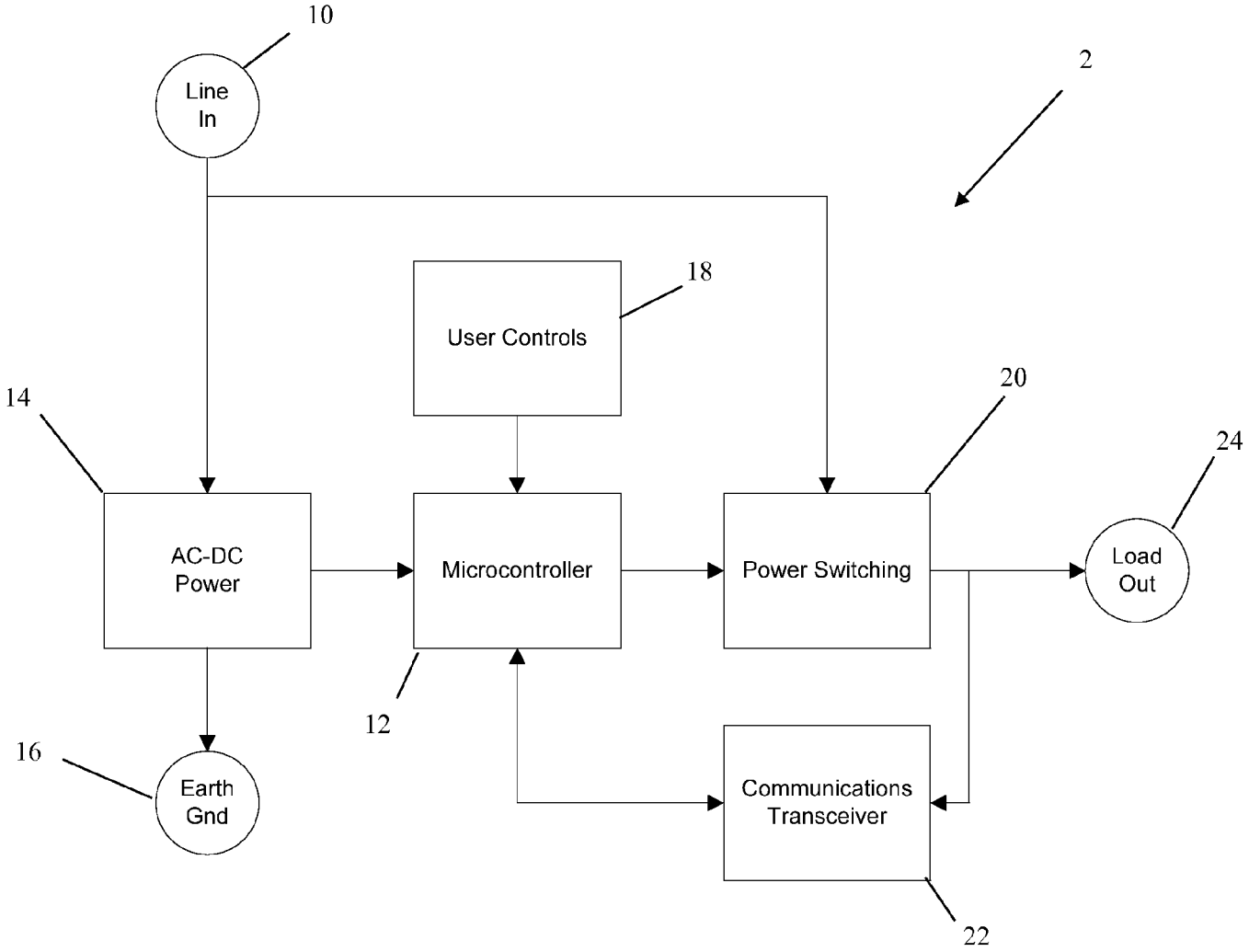
FIG. 2 is a schematic diagram of an exemplary control unit portion of the system of FIG. 1.

FIG. 2 shows an exemplary embodiment of the control unit 2 for use in controlling dimmer 6 and LED lamp 8. As previously noted, the control unit 2 may take the form of a wall box switch to enable manual user input in any of a variety of well known manners. Alternatively, or in addition, the control unit 2 may be controlled by an automated control system associated with the building in which the system 1 is installed.

The control unit 2 may include a line-in connection 10 for coupling to the building's electrical power supply grid. Input power from the line-in connection 10 may be provided to a microcontroller 12 via AC/DC power supply 14. The AC/DC power supply 14 may also include or provide the control unit's connection to ground 16 (the ground connection may be used where a neutral connection is not available, such as in typical retrofit applications). Input power from the line in connection 10 may also be provided to a power switching device 20 to provide power to the dimmer 6 (in FIG. 1) as commanded by the microcontroller 12. The microcontroller 12 may be coupled to user controls 18, the power switching device 20, and a communications transceiver 22. The power switching device 20 and the communications transceiver 22 may, in turn, be coupled to the dimmer 6 and LED lamp 8 via load-out line 24.

The power switching device 20 may be configured to control the AC sine wave used to power the dimmer 6. This control may be commanded by the microcontroller 12 in response to user input signals received by the microcontroller 12 from the user controls 18. As previously noted, the user controls 18 can include manual control, automated control, or a combination of both. The microcontroller 12 may, for example, receive input signals from the user controls 18 to control functions and/or features, such as light level, color, etc. of the LED lamp 8, and to transmit that control information via the communications transceiver 22.

As will be discussed in greater detail later, by adjusting the phase angle of the AC sine wave used to power the dimmer 6, the control unit 2 can command the dimmer 6 to provide a desired power level to the LED lamp 8 so as to achieve a desired brightness of the lamp.

The communications transceiver 22 may further be configured to transmit a control signal to the dimmer 6 as commanded by the microprocessor 12 via the load-out line 24. In one embodiment, the control signal is transmitted on a leading edge of the AC half sine-wave before the power switching device 20 is turned on. The nature of the control signal, and the AC half sine-wave, will be described in detail below.

As previously noted, in retrofit applications, there is often no neutral run through the electrical box which houses the wall box switch. In such cases, the connections may include only a line in connection, a switched load connection, and a ground connection. Efficient control electronics coupled with a current limited DC power supply may trickle a small amount of current (<500 uAmps) to the earth ground connection to complete the power supply circuit.

Figure 3:
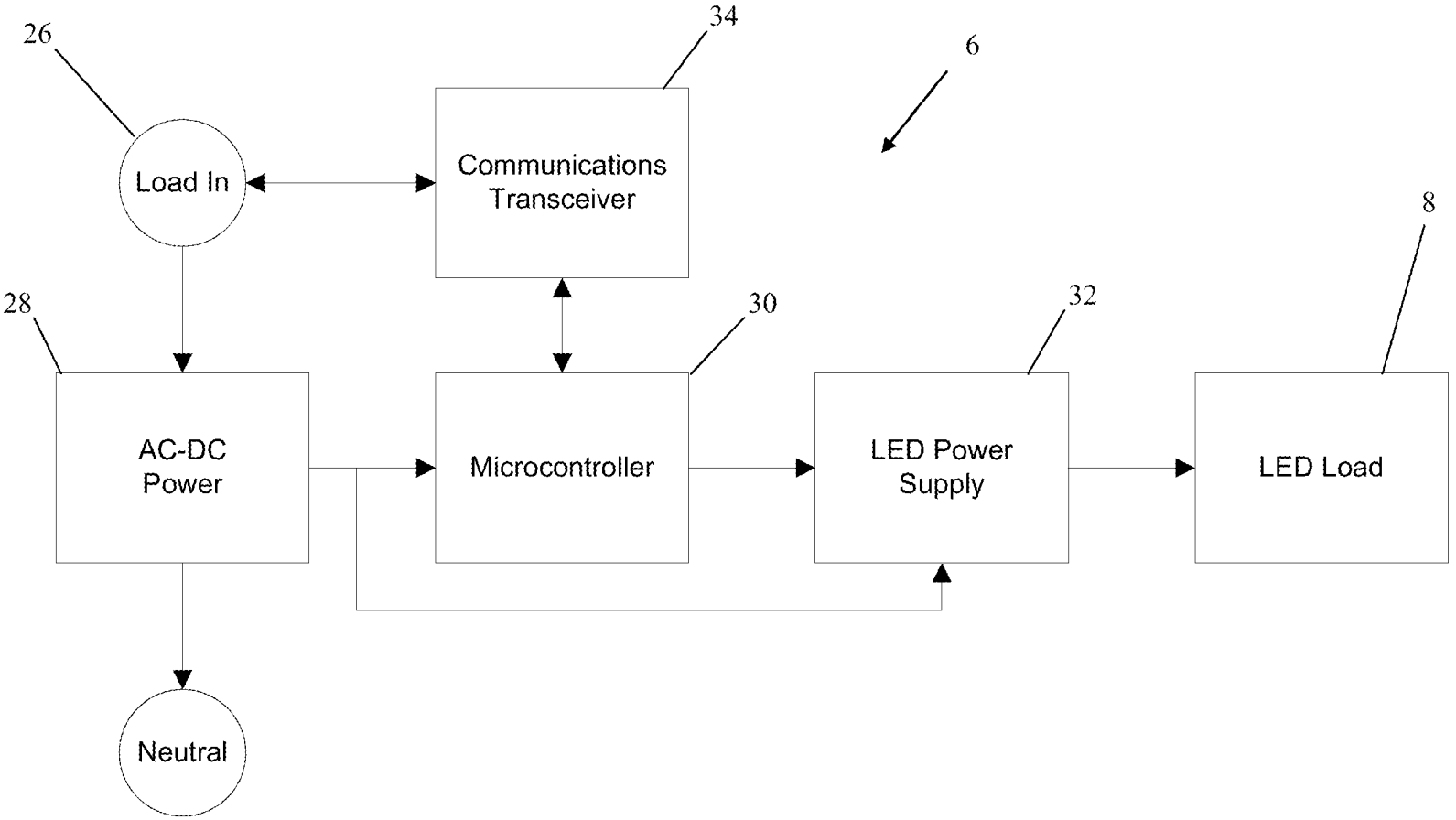
FIG. 3 is a schematic diagram of an exemplary dimmer and LED lamp portion of the system of FIG. 1.

Referring now to FIG. 3, the dimmer 6 and LED lamp 8 will be described in greater detail. The dimmer 6 may include a load-in connection 26 coupled to the load-out connection 24 of the control unit 2 (in FIG. 2) for receiving input power used for powering the dimmer 6 and the LED lamp 8. The load-in connection 26 also may serve to transmit control signals commanded by the control unit's microprocessor 12 (in FIG. 2) and injected by the control unit's communications transceiver 22. The dimmer 6 may further include a dimmer AC/DC power supply 28 coupled to the load-in connection 26 for powering a dimmer microcontroller 30 and an LED power supply 32. The LED power supply 32 may be implemented as any of a variety of technologies, including, but not limited to, pulse width modulation (PWM) or current control.

As previously noted, the control unit's microcontroller 12 can control the power switching device 22 to adjust the phase angle of the AC sine wave provided to the dimmer 6. The dimmer's microcontroller 30 can use this phase information to control the amount of DC power that is provided to the LED lamp 8. For example, the dimmer microcontroller 30 can proportionally change either a DC pulse width or a DC current supplied to the LED lamp 8 to control the lamp's brightness.

A dimmer communications transceiver 34 may be coupled between the load-in connection 26 and the dimmer microcontroller 30 for decoding control signals transmitted by the control unit's communications transceiver 22 and providing representative control signals to the dimmer microcontroller 30.

In some embodiments, the command signals can be used by the dimmer microcontroller 30 to control the LED lamp 8 to provide a desired dimming level, color control, etc. As will be discussed in greater detail later, the dimmer microcontroller 30 also can provide return communications with the control unit's microcontroller 12 to relay operational and/or status information regarding the dimmer 6 and/or the LED lamp 8.

The LED lamp 8 may include a single LED element (i.e., bulb), or it may include a plurality of LED elements for providing a desired total illumination capacity for a particular lighting application. Where a plurality of LED elements are used, they may be provided as an array of elements in any of a variety of geometric arrangements. In addition, the plurality of LED elements may be the same color (i.e., white, green, blue, red, etc.), or type (i.e., flood, tube, strip, etc.), or they may comprise different colors or types of elements.

One or both of the microcontrollers 12, 30 may execute instructions for adjusting a brightness, color, or other aspect of the LED lamp 8. Such instructions may be stored in memory associated with the respective microcontroller.

The dimmer microcontroller 30 may also communicate with the control unit microprocessor 12 to transmit information regarding the operational state (i.e., health, life, temperature, etc.) of the LED lamp 8. By providing the control unit 2 and the dimmer 6 with processing and communications capabilities, there is enhanced communications between system components, which in turn, provides enhanced system functionality.

As noted, the dimmer 6 may control operation of one or more LED lamps 8 located in a single room. Alternatively, the dimmer 6 may control operation of a plurality of LED lamps 8 positioned in a plurality of locations throughout a building. In addition, the dimmer 6 may be associated with a control system (not shown) for facilitating comprehensive control of lighting systems in one or more buildings.

Referring now to FIGS. 4-8, exemplary dimming operations will be described in relation to a variety of duty cycle control schemes. As will be understood, duty cycle is the proportion of time during which a component, device, or system is operated. The term duty cycle describes the proportion of "on" time to the regular interval or "period" of time. Thus, a low duty cycle corresponds to low power because the power is off for most of the time. Duty cycle is often expressed in percent, with 100% being fully on, and 0% being fully off.

As previously noted, typical incandescent lamp dimmers can cycle from 0% to 100% because the associated incandescent bulbs are capable of operating throughout such a power range. The low end of the duty cycle for an LED lamp is not 0%, but rather is a small power level (e.g., less than about 500 μAmps) that can maintain a minimum required power to the dimmer's communications and control electronics For example, in some embodiments, if the voltage is switched on at 150-degrees after the zero-crossing of the half sine wave for the minimum setting, the LED lamp 8 would be at minimum light level. Even at minimum light level, however, the LED lamp 8 would still be guaranteed to be receiving at least the last 30-degrees of the AC waveform to reliably power the electronic communications and control circuitry.

As will be described in greater detail later, the "off" periods in the duty cycle advantageously provide gaps in the power cycle which can be used to send data back and forth between the dimmer 6 and the control unit 2. For example, if the voltage is switched on at 30-degrees after the zero-crossing of the sine wave (for the maximum setting in which the LED lamp is at maximum light level) the first 30-degrees of the AC waveform are at zero voltage. This time period can be used to enable the control unit 2 to impress a voltage pulse on the line to the dimmer 6. This voltage pulse can be used to represent communications data for color control and various other control functions such as addressing commands to a group of LED lamps 8. This time period can also be used to send signals from the dimmer 6 back to the control unit 2. In one exemplary embodiment, such return signals can be used to indicate the operational state/status (e.g., end of life, temperature) of the associated LED lamps 8. It will be appreciated that the disclosed system and method are not limited to a duty cycle range of 30-degrees to 150-degrees. For example, the disclosed system and method may operate in a range of from about 20-degrees to about 160-degrees. Such a range would provide a wider range of dimming than relatively more constrained ranges.

Figure 4:
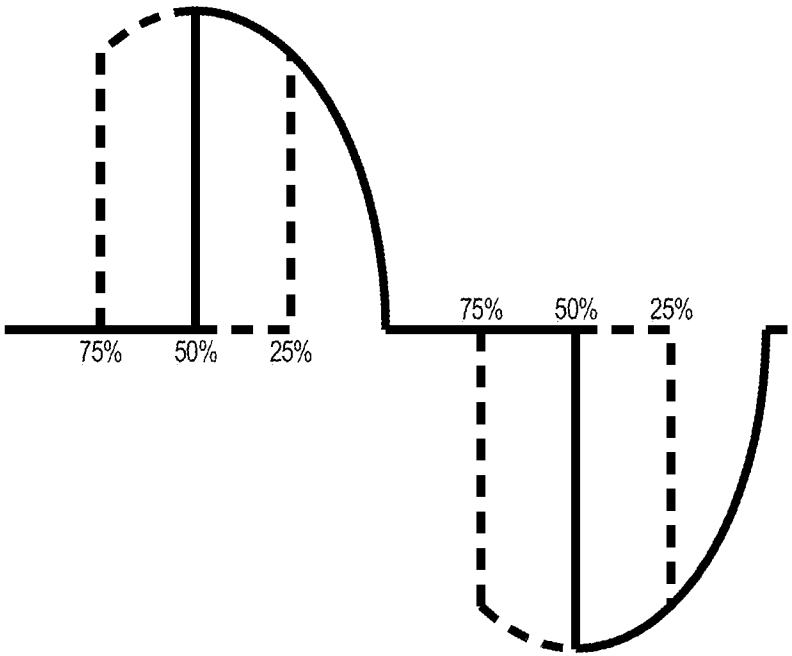
FIG. 4 illustrates a typical dimming technique using phase switching.

FIG. 4 illustrates a conventional dimming technique using phase switching. Back to back SCR's (thyristors) or TRIAC's (triodes) are typically used. During each half sine-wave, the power devices are left off at the start of a zero crossing and are turned on at some point along the sine-wave to vary the power to the load (i.e., the lamp).

FIG. 4 shows 25%, 50% and 75% switch points which correspond to proportional light intensities. If each half wave is left off for the full duration (i.e., 0% to 100%), the lamp remains off. If each half wave is turned on immediately (i.e., on for the full 100% of the half-sine wave), the lamp will shine at full brightness.

Figure 5:
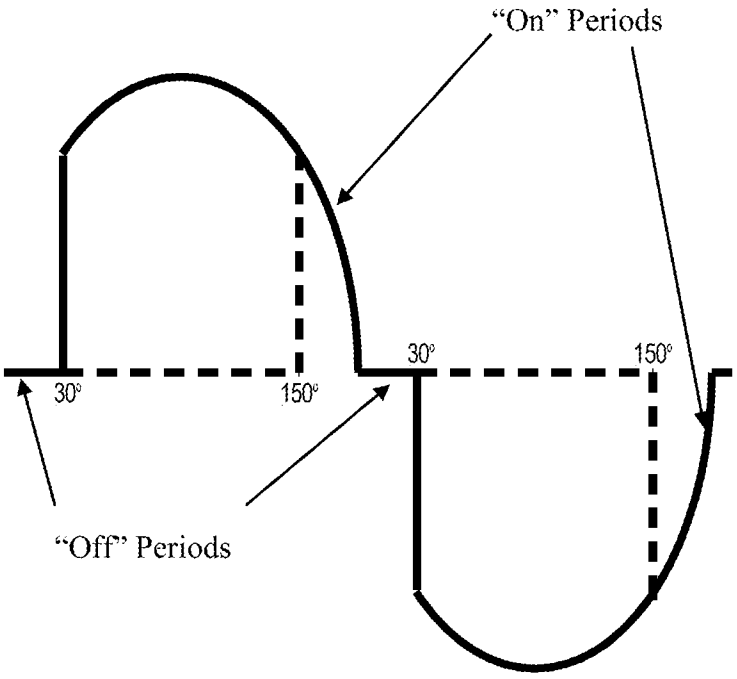
FIG. 5 illustrates an exemplary embodiment of the disclosed control technique in which the full range of dimming is limited between the 30-degrees and 150-degrees of each half sine-wave.

FIG. 5 shows an exemplary embodiment of the disclosed control technique in which the full range of dimming is limited between the 30-degrees and 150-degrees of each half sine-wave. 30-degrees represents "off" (i.e., the LED lamp 8 is dark), while 150-degrees represents full "on" (i.e., the LED lamp 8 is a full brightness). As will be described in greater detail later, the region between 0-degrees and 30-degrees (i.e., the LED lamp's "off" period) is reserved for digital signaling between the dimmer and the LED lamp 8. The region between 150-degrees and 180-degrees of the half sine-wave is always "on", and provides sufficient power to the LED lamp 8 to provide constant power to the dimmer circuitry. As noted, the disclosed technique is not limited to a particular duty cycle range, and ranges other than 30-150 degrees can also be used.

Figure 6:
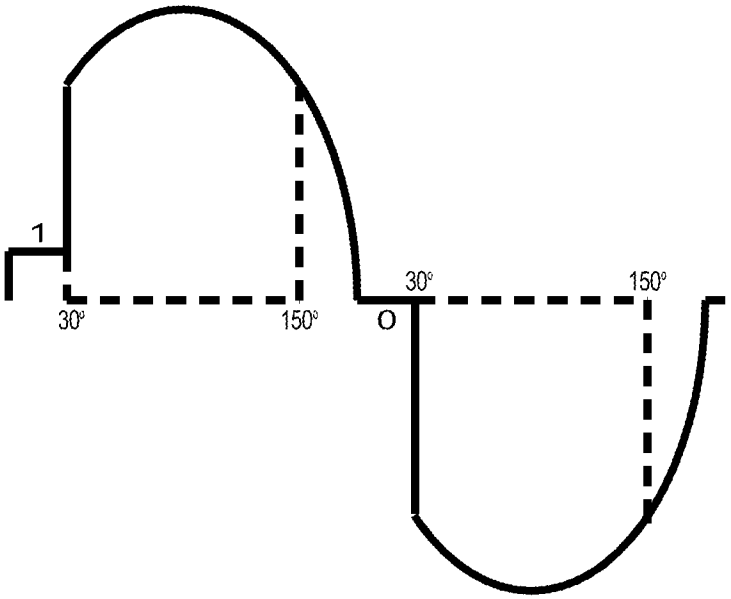
FIG. 6 illustrates an exemplary embodiment in which each half sine-wave carries digital information by inserting one or more digital voltage levels in the 0° to 30° half region.

As previously noted, the dimmer 6 and control unit 2 may signal each other by exchanging voltage pulses during the aforementioned "off" periods. FIG. 6 shows an exemplary embodiment in which each half sine-wave carries digital information by inserting one or more digital voltage levels in the 0-degree to 30-degree half region. In the illustrated embodiment, a logical "1" level is impressed as part of the positive half sine-wave, while the negative half sine-wave shows a logical "0" level. Such "1" and "0" levels can be used to control one or more features or functions of the LED lamp 8.

Each pulse (one or multiple) may last the entire "off" period of the first part of the duty cycle, or the pulses may be chopped up into multiple bits. Pulses may be on the order of a one millisecond pulse or a half millisecond pulse. In the illustrated embodiment, voltage presence may indicate a "1" data bit, while no voltage may be a "0" data bit.

The desired control information can be sent as one or more bits. One bit, on an electrical medium, may be the electrical signal corresponding to binary "0" or binary "1." In one non-limiting example, 0 volts corresponds to binary "0", and +5 volts corresponds to binary "1." More complex encoding schemes may also be used, as desired.

To overcome issues such as attenuation, reflection, noise, dispersion, or collision of such signals, more than one bit may be transmitted to represent individual pieces of information to be sent between the control unit 2 and dimmer 6. In some embodiments, packets and/or frames containing a plurality of individual bits may be used to transmit information between the control unit 2 and dimmer 6.

Some loads (e.g., inductive loads), can be damaged by a DC component riding on an AC waveform. Thus, to prevent a DC component from being added to the AC waveform for the subject system, encoding of the logic levels can be used. As will be appreciated, encoding may be used to convert "1s" and "0s" into an electrical pulse that can be transmitted between the control unit 2 and dimmer 6. In one exemplary embodiment, a Manchester encoding technique is used. In Manchester encoding, no DC component is introduced. Rather, the voltage has the bits encoded as transitions. Specifically, upward transitions in the signal mean binary 1 and downward transitions mean binary 0. Other encodings may also be used. For example, NRZ encoding may be used in arrangements where loads will not be damaged by a DC component riding on an AC waveform, since NRZ encoding does introduce such a DC component. NRZ encoding is characterized by a high signal and a low signal, often +5 or +3.3 Volts for binary "1" and 0 Volts for binary "0."

Figure 7:
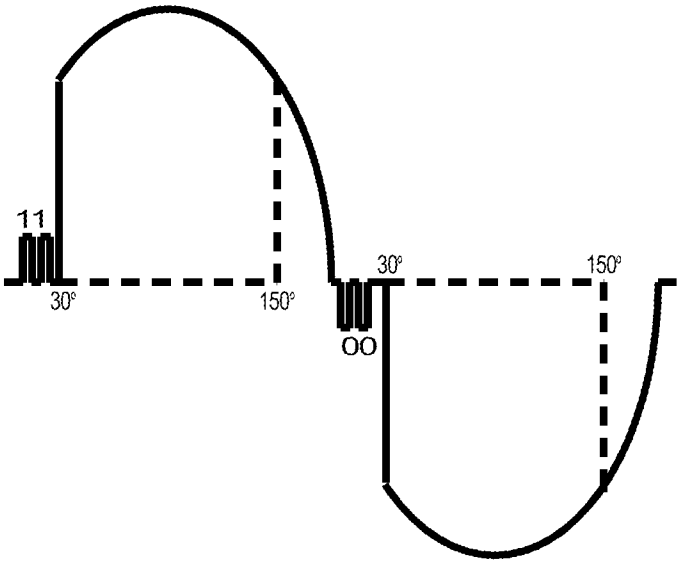
FIG. 7 illustrates an exemplary Manchester encoding system in which each half wave has two bits inserted in the first 30-degrees.

FIG. 7 shows an exemplary Manchester encoding system in which each half wave has two bits inserted in the first 30-degrees. The positive half wave shows a logical "11" bit, while the positive half wave shows a logical "00" bit. These signals can be used to control one or more features or functions of the LED lamp 8.

Figure 8:
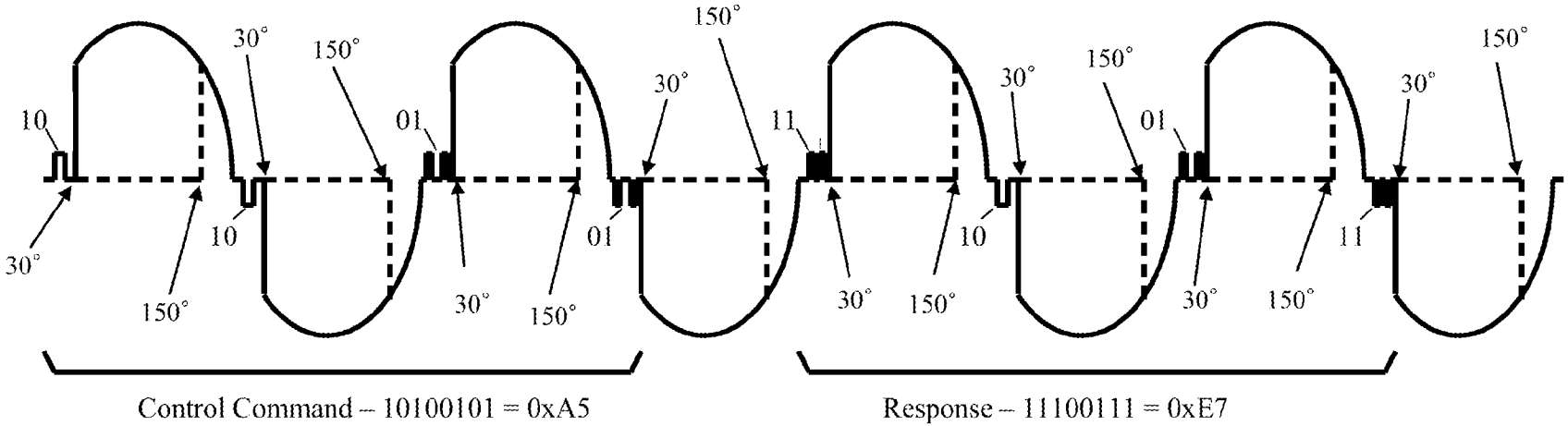
FIG. 8 illustrates an exemplary embodiment for sending a variety of signals between the dimmer and LED lamp.

FIG. 8 illustrates a technique for sending a variety of signals between the dimmer 6 and LED lamp 8. A series of half waves are shown in which an 8-bit control command (from control unit 2) is transmitted over the first four half waves to the dimmer 6. The last four half waves constitute an 8-bit dimmer 6 (or control unit 2) response. The illustrated command is 10100101b followed by a response of 11100111b. One of ordinary skill in the art will appreciate that such a command scheme can be used to enable communication of a wide variety of detailed information between the control unit 2 and dimmer 6.

Thus arranged, the disclosed control system can be used to exchange a variety of information between the dimmer 6 and the LED lamp 8. For example, the dimmer 6 may be configured to send information to the control unit 2 relating to the operational state or health of the LED lamp 8. In one non-limiting exemplary embodiment, such information may represent an estimate of the end of life of the LED lamp 8, though any of a variety of other information can also be provided.

As will be appreciated, the disclosed arrangement may facilitate enhanced demand response and load shedding features. For example, the control unit 2 and dimmer 6 may receive information from a utility or building automation system and may use that information to instruct one or more LED lamps 8 to operate at a particular power level.

In one exemplary embodiment, intelligent meters may be positioned throughout a building and used to monitor power consumption via one or more dimmers 6. Such information may be collected and sent via the Internet to a web page to enable remote monitoring. The associated utility, building manager, or other authorized individual or agency may then monitor this information to determine if one or more users are consuming more power than desired. In some embodiments, the web page may be employed by an authorized user to control operation of individual LED lamps 8 or groups of lamps by sending instructions to the associated dimmer 6 via the building automation system. Again, such instructions can be provided via the aforementioned voltage pulse control scheme. This arrangement may also enable a home owner to remotely control a home lighting system.

Other examples of customized dimmer control of one or more associated LED lamps 8 include color control, in which the color temperature (e.g., warm light, cool light) can be adjusted to suit a particular application. This feature may be added to the disclosed brightness control (i.e., dimming) feature by adding color control data to the voltage pulse or pulses sent from the control unit 2 to the dimmer 6. In some embodiments, color may be preset (e.g., several selections of color temperature may be used), and may be set by the dimmer 6 (or control unit 2) to occur at particular time periods. For example, a "cool" color can be used during a meeting to keep people awake or to read documents, while a "warmer" color may be used during lunch time.

The disclosed system may also facilitate zoning of LED lamps. As previously noted, with current systems, multiple LED lamps that are connected on the same wire cannot be independently controlled. With the disclosed system, the control unit 2 may send data along the line in the form of the previously described voltage pulses, and these voltage pulses may include address information that can be recognized by the microcontroller 30 of the targeted dimmer 6 for controlling a specific LED lamp 8. Thus, the LED lamp 8 for which the instruction is intended may adjust its brightness, color, or other characteristic, while other LED lamps 8 on the same wire may disregard the instruction. In this manner, each LED lamp 8 or group of LED lamps 8 can be instructed to operate in a desired manner. This arrangement may enable a relatively small number of dimmers to control a large number of individual LED lamps in a customized fashion.

As previously noted, the voltage pulse or pulses may be sent from the control unit 2 to the dimmer 6 to provide operational or control information for controlling one or more LED lamps 8. For example, one or more voltage pulses may represent data bits and may occur on each positive and/or negative half-cycle of the sine wave. The accumulation of these data bits may form data frames which may relay digital information from the control unit to the dimmer circuitry. Such pulses may be sent as the first portion of the duty cycle.

In other embodiments, a portion of the time period during the first 30 degrees during certain half sine waves may be reserved for communicating information from the dimmer 6 to the control unit 2. For example, the control unit 2 may remain at zero volts during this first 30 degrees during certain half sine waves, and the dimmer 6 may impress a voltage pulse to return digital data to the control unit 2.

Such information communication may be implemented in network systems with modules that can generate phase control pulses. For example, in some large scale applications, dimmers 6 may be disposed in a central cabinet or they may be distributed and connected to a network having one or more dispersed low voltage control systems. In such applications, the system could be configured to periodically query the status/operational state of particular LED lamps 8 (e.g., end of life, temperature). Such an arrangement could be a master/slave arrangement in which the control unit 2 transmits an update request message to the dimmer 6 and then goes quiet while the dimmer 6 transmits a status update message to the control unit 2.

Lighting level changes are expected to be executed with low latency because users are accustomed to the quick response of incandescent lamps and dimmers. This disclosed system and control method may assure the same quick response of lighting level control as seen with incandescent lamps and dimmers. This disclosed system and method may facilitate the execution of color changes in times as short as 100-200 milliseconds which should be acceptable to the user.

Figure 9:
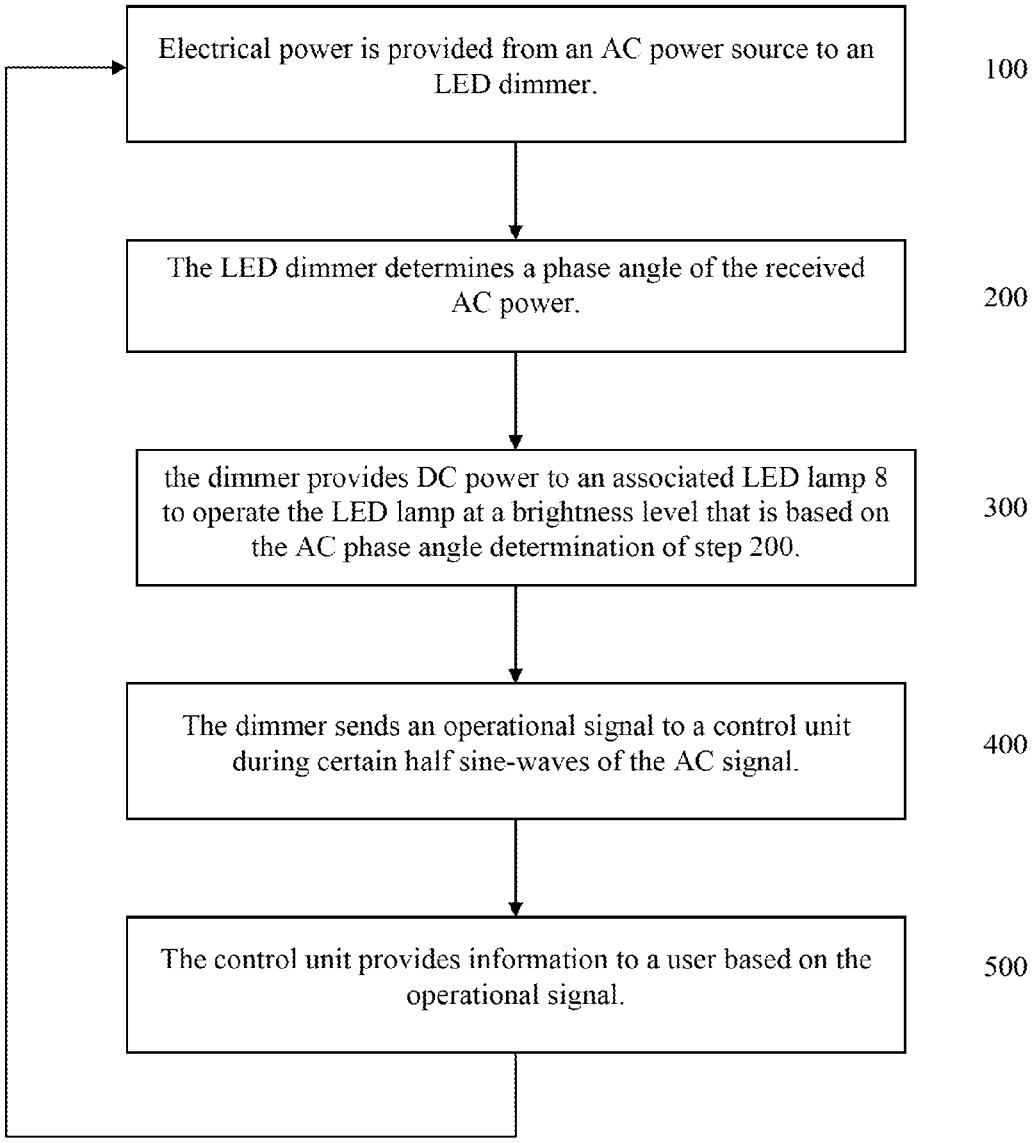
FIG. 9 is a flow chart illustrating an exemplary method of operating the system of FIG. 1.

An exemplary method of using the disclosed system 1 will now be described in relation to FIG. 9. At step 100, electric power is provided from an alternating current (AC) source to an LED dimmer. In one embodiment, the AC power provides a constant minimum level of power to circuit components associated with the dimmer communications and control electronics. At step 200, the LED dimmer determines a phase angle of the received AC power. In some embodiments, a control signal is also transmitted from a control unit 2 to the dimmer 6 during a first portion of the half sine-wave of the AC power provided to the dimmer. In one embodiment, the control signal is a voltage pulse impressed on a wire coupled to the dimmer 6. In other embodiments, the control signal is a plurality of voltage pulses representing a packet of data. The control signal can contain information regarding a desired brightness of an LED lamp 8 associated with the dimmer 6. The control signal can also, or can alternatively, contain information regarding a desired color of the LED lamp 8. At step 300, the dimmer provides DC power to an associated LED lamp 8 to operate the LED lamp at a brightness level that is based on the AC phase angle determination of step 200. In some embodiments, the dimmer 6 may also modify at least one operational function of the associated LED lamp 8 in response to a control signal received from the control unit 2. At step 400, the dimmer 6 sends an operational signal to the control unit 2 during certain half sine-waves of the AC power. In one embodiment, the operational signal includes end of life information for the associated LED lamp. At step 500, the control unit 2 provides information to a user based on the operational signal. The method may then return to step 100.

It will be appreciated that the disclosed system and method can have various advantages over present systems. For example the disclosed system and method may use existing wiring and infrastructure. Further, the disclosed system and method can be implemented at a relatively low cost as it requires relatively few additional parts to the control unit and the dimmer. Further, the system and method do not use wireless (e.g., radio frequency) or special carrier waves that are typically subject to interference from other devices.

Some embodiments of the disclosed device may be implemented, for example, using a storage medium, a computer-readable medium or an article of manufacture which may store an instruction or a set of instructions that, if executed by a machine (i.e., processor or microcontroller), may cause the machine to perform a method and/or operations in accordance with embodiments of the disclosure. Such a machine may include, for example, any suitable processing platform, computing platform, computing device, processing device, computing system, processing system, computer, processor, or the like, and may be implemented using any suitable combination of hardware and/or software. The computer-readable medium or article may include, for example, any suitable type of memory unit, memory device, memory article, memory medium, storage device, storage article, storage medium and/or storage unit, for example, memory (including non-transitory memory), removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision additional modifications, features, and advantages within the scope and spirit of the claims appended hereto.

What is claimed is:

1. A system for dimming a light emitting diode (LED) lamp, comprising:

an LED lamp, and an LED dimmer coupled to the LED lamp, the LED dimmer configured to receive electrical power from an alternating current (AC) source, the LED dimmer comprising a processor and associated memory, the processor executing instructions for:

determining a phase angle of said received AC power, controlling direct current (DC) power to the LED lamp based on said determined phase angle, and controlling a dimming range of the LED lamp in a range between a maximum brightness condition of the LED lamp and an off condition of the LED lamp;

wherein when the LED lamp is in the off condition the AC power source provides a constant minimum level of electrical power to circuit components of the LED dimmer and the LED lamp.

2. The system of claim 1, wherein the processor associated with the dimmer is configured to receive a control signal from a control unit during a first portion of each half sine-wave of the received AC power, the processor associated with the dimmer programmed to control an operating function of the LED lamp based on the control signal.

3. The system of claim 1, wherein the processor associated with the dimmer is configured to send an operational signal to the control unit during a portion of a half sine-wave of the AC power signal.

4. The system of claim 2, wherein the control signal comprises a voltage pulse.

5. The system of claim 2, the dimmer further comprising an LED power supply.

6. The system of claim 2, wherein the operational function comprises a color of light emitted by the LED lamp.

7. The system of claim 2, comprising a plurality of LED lamps coupled to the LED dimmer, and wherein the control signal includes address information associated with a selected one of said plurality of LED lamps, the processor associated with the dimmer programmed to control the LED dimmer to modify an operational characteristic of only said selected one of said LED lamps based on the control signal.

8. The system of claim 1, wherein the dimmer includes a processor with a memory coupled thereto, and the control unit includes a processor with a memory coupled thereto.

9. A method for controlling brightness of an LED lamp, comprising:

receiving, at an LED dimmer, electrical power from an alternating current (AC) source;

determining, by a processor associated with the LED dimmer, a phase angle of said received AC power, and at the processor, controlling the LED dimmer to provide power to the LED lamp to operate the LED lamp at a brightness based on the determined AC phase angle, wherein the brightness level is in a range between a maximum brightness condition of the LED lamp and an off condition of the LED lamp;

wherein when the LED lamp is in the off condition the AC power source provides a constant minimum level of electrical power to circuit components of the dimmer and the LED lamp.

10. The method of claim 9, wherein the received AC power comprises a duty cycle of from about 30-degrees to about 150 degrees of each half sine-wave of the AC source.

11. The method of claim 9, further comprising receiving a control signal at the dimmer during a first portion of each half sine-wave of the received AC power.

12. The method of claim 11, wherein the control signal comprises a voltage pulse impressed on a wire coupled to the dimmer.

13. The method of claim 11, wherein the processor instructs the dimmer to modify at least one operational characteristic of the LED lamp.

14. The method of claim 13, wherein the operational characteristic comprises a color of light emitted by the LED lamp.

15. The method of claim 11, wherein the control signal includes address information associated with one of a plurality of LED lamps, the method further comprising modifying an operational characteristic of only said one of said LED lamps based on the control signal.

16. The method of claim 11, further comprising sending an operational signal from the dimmer to a control unit during half sine-waves of the received AC power.

17. The method of claim 16, wherein the operational signal includes end of life information for the LED lamp.

18. A system for controlling a light emitting diode lamp for use in a system comprising an LED lamp connected to and in communication with a dimmer, and a non-transient machine readable storage medium encoded with a computer program code such that, when the computer program code is executed by a processor, the processor performs a method comprising:

receiving, at the dimmer, electrical power from an alternating current (AC) source;

determining, at the processor, a phase angle of said received AC power, and at the processor, controlling the dimmer to provide direct current (DC) power from the dimmer to an LED lamp, the DC power representative of a predetermined brightness of the LED lamp, the DC power based on the determined AC phase angle, wherein the predetermined brightness level is in a range between a maximum brightness condition of the LED lamp and an off condition of the LED lamp;

wherein when the LED lamp is in the off condition said AC power source provides sufficient power to the dimmer and the LED lamp to maintain a functionality of a circuit components of the dimmer and the LED lamp.

19. The system of claim 18, when the computer program code is executed by the processor, the processor further performs a method comprising receiving, at the processor associated with the dimmer, a control signal during a first portion of each half sine-wave of the received AC power.

20. The system of claim 19, wherein the control signal comprises a voltage pulse impressed on a wire coupled to the dimmer.

21. The system of claim 19, when the computing program code is executed by the processor, the processor further performs a method comprising modifying at least one operational function of said LED lamp based on the control signal.

22. The system of claim 21, wherein said operational function comprises a color of light emitted by the LED lamp.

23. The system of claim 19, wherein the control signal includes address information associated with a selected one of a plurality of LED lamps, when the computing program code is executed by the processor, the processor further performs a method comprising modifying an operational characteristic of only said selected one of said LED lamps based on the control signal.

24. The system of claim 19, further comprising sending, from the dimmer, an operational signal to a control unit during a second portion certain half sine-waves of the received AC power.

25. The system of claim 18, wherein the AC power source provides the received power to the dimmer so that the received AC power has a duty cycle of from about 30-degrees to about 150 degrees of each half sine-wave of the AC source.

* * * * *